US005771925A

United States Patent [19]

Lewandowski

[11] Patent Number: 5,771,925

[45] Date of Patent: Jun. 30, 1998

[54] SOAP DISPENSER AND WASH SIGNAL DEVICE

[76] Inventor: James Lewandowski, 1845 McKinney Ave., Benson, Minn. 56215

[21] Appl. No.: 754,404

[22] Filed: Nov. 27, 1996

[51] Int. Cl.[6] ..... E03B 7/07

[52] U.S. Cl. ..... 137/552.7; 222/39; 222/638

[58] Field of Search ..... 137/552.7, 624.13, 137/624.11; 222/39, 638, 181.3, 181.2

[56] References Cited

U.S. PATENT DOCUMENTS

| | | | |
|---|---|---|---|
| 1,885,979 | 11/1932 | Bobrick | 222/181.2 |
| 1,958,663 | 5/1934 | Harmon | 137/552.7 |
| 2,545,928 | 3/1951 | Martin et al. | 137/552.7 |
| 4,146,156 | 3/1979 | Cassia | 222/181.2 |
| 4,606,085 | 8/1986 | Davies | 4/623 |
| 4,836,415 | 6/1989 | Grussmark | 222/39 |
| 4,896,144 | 1/1990 | Bogstad | 340/691 |
| 4,991,755 | 2/1991 | Grusmark | 222/39 |
| 5,625,908 | 5/1997 | Shaw | 4/623 |

*Primary Examiner*—Denise L. Ferensic
*Assistant Examiner*—Joanne Y. Kim
*Attorney, Agent, or Firm*—Robert E. Kleve

[57] ABSTRACT

The invention comprises a signaling device for a soap dispenser. The signalling device is mounted in the housing of the soap dispenser which has a pivotally mounted soap dispensing handle; and when pivotally moving the soap dispensing handle, the movement of the handle causes activation of the signalling device, immediately after dispensing the soap. The signalling device has an electrical circuit with a flexing panel which upon movement of the flexing panel by the engagement of the handle against the panel, it triggers an initial alarm or sound to signal to the operator that the timing interval for the operator to wash his hands with the dispensed soap has begun. The activated circuit thereafter counts a selected interval of time in seconds considered adequate for the operaor to thoroughly wash his hands; and at the end of that interval, the circuit sounds a second alarm or sound indicating that the washing time is over. The circuit then resets itself to repeat the sequence.

2 Claims, 1 Drawing Sheet

SOAP DISPENSER AND WASH SIGNAL DEVICE

This invention relates to signalling devices for soap dispensers and the like.

It is an object of the invention to provide a novel signaling device which upon activation will signal an alarm at a timed interval has elapsed after dispensing soap that is considered adequate for thoroughly washing one's hands with the dispensed soap.

It is another object of the invention to provide a novel signaling device for soap dispensers which is mounted to the dispenser to be engaged by the soap dispensing handle so that upon dispensing soap with the handle, the device will activate and count electrically until an interval of time has elapsed considered adequate for thoroughly washing one's hands before sounding an alarm.

It is a further object of the invention to provide a novel signaling device for mounting to a soap dispenser for engagement and activation by movement of the soap dispensing handle, with the signaling device, immediately upon activation, signaling an initial alarm to indicate its activation; and thereafter clocking a timed interval considered adequate for thoroughly washing one's hands and thereupon sounding a second alarm, to thereby signal to the operator when to start and when to finish washing his hands so that the operator may know how long a time interval he should be washing his hands with the dispensed soap.

It is another object of the invention to provide a novel signaling device for operation in conjunction with a soap dispenser to signal to the operator dispensing the soap how long he should be washing his hands with the soap.

Further objects and advantages of the invention will become apparent as the description proceeds and when taken in conjunction with the accompanying drawing wherein:

BRIEF DESCRIPTION OF PREFERRED EMBODIMENT

Briefly stated, the invention comprises a signaling device for mounting in a soap dispenser. The soap dispenser has a housing with a soap dispensing handle pivotally mounted to the housing which upon pivoting the handle, the handle dipenses soap and also has a portion engaging the signaling device causing its activation. The signaling device has an electrical circuit, which immediately upon activation, triggers an alarm to signal to the operator that timing interval for the operator to wash his hands has begun. The circuit thereafter counts a selected interval of time in seconds considered adequate for the operator to thoroughly wash his hands and at the end of that interval sounds a second alarm indicating that the washing time is over. The circuit then resets iself to repeat the sequence.

Figure 1:
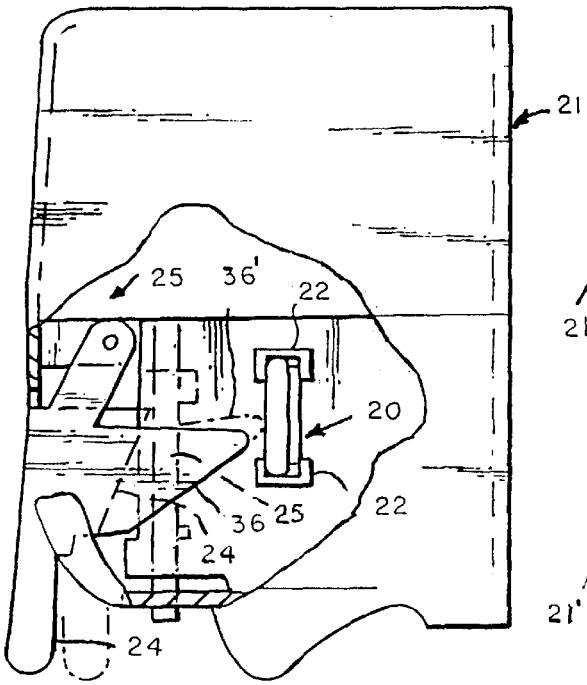
FIG. 1 is a side elevational view of the signaling device mounted in a soap dispenser.
Figure 2:
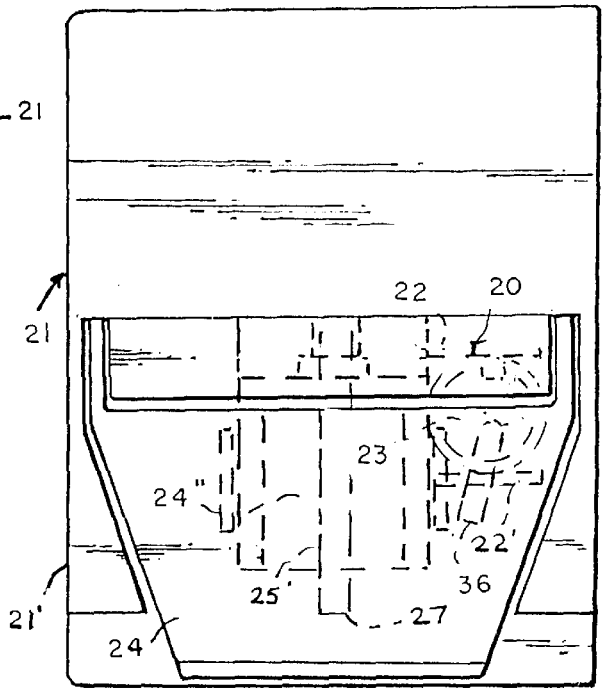
FIG. 2 is a front elevational view of the signaling device in a soap dispenser.
Figure 3:
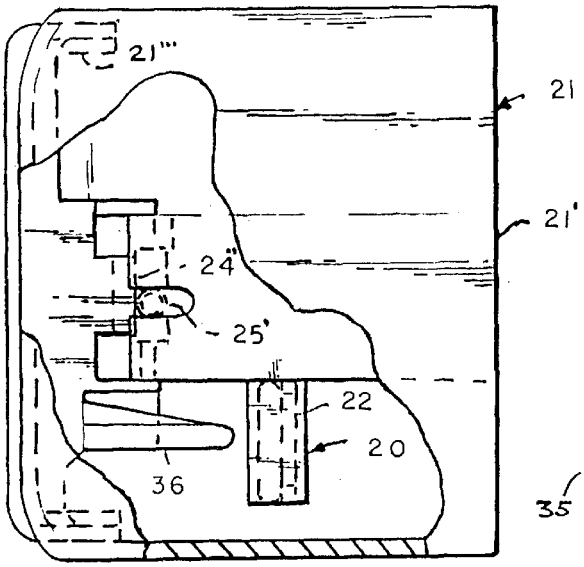
FIG. 3 is a top view of the signaling device in a soap dispenser.
Figure 4:
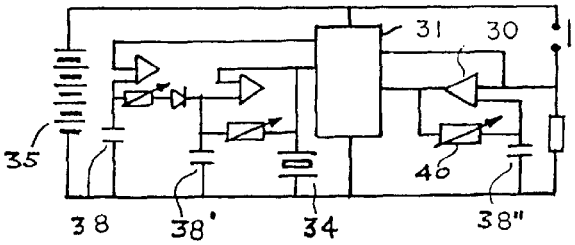
FIG. 4 is a schematic circuit diagram of the signal device.

Referring more particularly to the drawing, in FIGS. 1–3, inclusive, the signalling invention device 20 is illustrated mounted in the housing 21' of a conventionally operated soap dispenser. The device 20 is slidably mounted horizontally into the slot 22 formed by the upper and lower chanels 22' fixed to the inside frame 21" of the dispenser. The signalling device has a flexible metal panel 23 across one face of the signalling device, with the electric circuitry and battery mounted in the opposing circular housing 20' of the device. Upon pressing of the panel 23 inward, or left to right when viewed from FIG. 1, the signaling device is activated. The device may be operated with a variety of different types of dispensers having a movable handle 24, which in the illustrated form is pivotally mounted at its upper end 24 to the flanges 21"' fixed to the housing so that pivoting the handle counterclockwise, when viewed from FIG. 1, pivots a projecting flange modification 36 to cause the flange to engage the metal panel 23 and activate the device.

The handle 24 has an intermediate block portion 24, which when pivoted counter clockwise, engages initially the conventional flexible tubular outlet extension compresses the tubular outlet 25' causing soap to be dispensed, while in its same movement the flange 36 engages the metal panel 23 of the signaling device and activateds the signaling device.

The soap dispenser 21 operates in a conventional manner having a flexible bag 25 mounted in the upper portion of the housing. The bag has a flexible tubular outlet 25' in its bottom portion which is beside the block portion 24 of the handle and immediately above the outlet spout 27 of the dispenser, so that pivoting the handle 24 counter clockwise about its pivotal mounting 28 causes its block portion 24 to engage against the tubular outlet 25' compressing its sides together, and the reaction causes a quantity of liquid soap in the outlet from the bag to be dispensed out the outlet and out the spout.

The handle 24 has a projecting flange 36 fixed to its inside surface, which projects inward toward the outer metal panel 23 of the signaling device 30. Upon movement of the handle counterclockwise when viewed from FIG. 1, the projecting flange 36 moves toward the metal panel while the intermediate flat portion 24" of the handle moves toward and against the tubular outlet 25' compressing it to dispense soap, and the flange 36 engages the metal panel 23, immediately after the flat portion engages the tubular outlet flexing the metal panel inward depressing the metal switch to its on or closed position to start the signaling device. The metal panel will be able to compress enough when being activated to allow the intermediate portion 25' of the handle to fully compress the tubular outlet to force the desired amount of soap out of the tubular outlet.

The metal panel 23 being flexed causes the switch 29 to close to start the signaling device by causing IC3 (30) to start IC4 (31), which enables the three terminals 1,2,3 to all be high levels. Terminal 1 triggers ICL (32) which generates pulses with an interval of one second. This in turn controls the beeping interval of IC2 (33) through D1. Terminal 2 triggers IC2 (33). The beeping frequency (tone) is controlled by IC2 (33), and the Piezoresonator 34 is directly driven to sound. IC2 (33), after being driven to make three beeps, then turns off. IC2 is restimulated after 15 seconds by terminal 2 to make four (4) ending beeps. Then IC4 switches off automatically and the whole process ends. The process begins all over again when the flexing metal panel 23 is again pressed. The circuit is powered by a 3V battery 35.

OPERATION

The purpose of the signaling device 20 installed in a soap dispenser is to signal when the necessary amount of time has elapsed for effective cleaning and handwashing, once the soap has been dispensed by the operator onto his hands for washing his hands.

Immediately upon the pressing of the handle 24 by the operator to pivot the flange 36 against the metal panel 23 of the signaling device, the device 20 activates and beeps three times. The handle has in the same movement dispensed soap onto the operator's hands. The operator, for proper hand washing, is instructed by suitable instruction given or placed near the dispenser, to wash his hands until the signaling device beeps again. The device will beep again four times after fifteen seconds have elapsed from the initial three beeps, which is considered sufficient for thorough washing of one's hands. If the operator has washed his hands for the full fifteen seconds, then he accomplished the washing satisfactory.

While the preferred form of the invention is mounting the signaling device in a soap dispenser having a modifed handle operated to activate the signaling device, and to be activated when the soap dispensing handle is moved to dispense soap, the signaling device may be mounted on the exterior of a soap dispenser. The signaling device may also have adhesive applied to the side 37 opposite the flexing panel and the device mounted by the adhesive to the exterior housing of a conventional soap dispenser. In this case, the operator will have to press the flexing panel 23 separately from the movement of the soap dispensing handle.

Thus, it will be seen that a novel signaling device has been provided for operation with a soap dispenser which will signal to a person washing his hands how long he should be washing them with the soap dispensed by the dispenser, before he can consider he has washed his hands thoroughly. The amount of time recommended by the Center for Disease Control and Prevention is fifteen to seventeen seconds for washing the hands.

In FIG. 1, the handle is shown having been pivoted its projecting flange 36 against the resilient metal panel 23 by the fragmentary showing in phantom lines 36'. The metal panel 23 will sufficient resilient to resume it original shape after being engaged and depressed by the flange 36 to act to close the switch 29 to the circuit beeping sequence. The circuit will having customary capacitors 38, 38', and 38" and variable resistors 40,40', and 40" of the range of 470K, 220K, and 1M, respectively, and the resistor 40"" of 100K range for a circuit of this character.

It will be obvious that various changes and departures may be made to the invention without departing from the spirit and scope thereof; and accordingly, it is not intended that the invention be limited to that specifically described in the specification or as illustrated in the drawing, but only as set forth in the appended claims wherein:

What is claimed is:

1. A soap dispensing and washing timer signaling device comprising a soap dispenser device and a signaling timer device, said soap dispenser having a housing, said signaling timer device having a housing with a flexible activation panel on one side and an adhesive mounted on its other side, said signaling timer device having electrical counting means and signaling means and a battery in said signaling timer device housing, said signaling device being mounted to the exterior of said soap dispenser housing by said adhesive, said panel being flexible for activation of said electrical counting means by said operator compressing said panel with his hand and with said panel upon compression activating said counting means on said device so that said counting means will immediately sound an alarm to indicate the start of the timing and will count an interval time considered adequate for washing a person's hands and will sound an alarm when said device has counted the interval of time considered adequate for washing one's hands.

2. A soap dispensing and washing timer signaling device comprising a soap dispenser and a signal timer device, said soap dispenser having a housing, said signaling timer device having a housing with a flexible panel on one side and means to secure the signaling timer housing to the dispenser on the other side, said signaling timer device having electrical counting means, signaling means and battery means in said signal timer housing, said panel being flexible for activation of said electrical counting means by said operator compressing said panel with said panel upon compression activating said counting means on said signaling timer device so that said counting means will immediately sound an alarm to indicated the start of the timing and will count an interval of time considered adequate for washing a person's hand and will sound an alarm when said device has counted the interval of time considered adequate for washing's one hands.

* * * * *